US006739159B2

(12) United States Patent
Sciacca

(10) Patent No.: US 6,739,159 B2
(45) Date of Patent: May 25, 2004

(54) METHOD FOR PRODUCING TUBULAR KNITWEAR ITEMS AND PRODUCTS OBTAINED THEREBY

(76) Inventor: Franco Sciacca, Via Veneto, 18, 22070 Cassina Rizzardi (IT)

( * ) Notice: Subject to any disclaimer, the term of this patent is extended or adjusted under 35 U.S.C. 154(b) by 0 days.

(21) Appl. No.: 10/297,394

(22) PCT Filed: May 28, 2001

(86) PCT No.: PCT/IT01/00268

§ 371 (c)(1),
(2), (4) Date: Dec. 5, 2002

(87) PCT Pub. No.: WO01/94670

PCT Pub. Date: Dec. 13, 2001

(65) Prior Publication Data

US 2003/0131634 A1 Jul. 17, 2003

(30) Foreign Application Priority Data

Jun. 9, 2000 (IT) ..... CO2000A0014

(51) Int. Cl.[7] ..... D04B 9/00
(52) U.S. Cl. ..... 66/8
(58) Field of Search ..... 66/169 R, 170, 66/171, 172 R, 173, 172 E, 175, 176, 177, 178 R, 190, 8, 9 R, 25

(56) References Cited

U.S. PATENT DOCUMENTS

| | | | | | |
|---|---|---|---|---|---|
| 4,010,627 | A | * | 3/1977 | Pernick | 66/177 |
| 4,682,479 | A | * | 7/1987 | Pernick | 66/176 |
| 5,081,854 | A | * | 1/1992 | Lonati | 66/176 |
| 5,836,179 | A | * | 11/1998 | van Laar | 66/171 |
| 6,082,145 | A | * | 7/2000 | Lonati et al. | 66/176 |
| 6,164,094 | A | * | 12/2000 | Lonati et al. | 66/172 R |

* cited by examiner

*Primary Examiner*—Danny Worrell
(74) *Attorney, Agent, or Firm*—James B. Conte; Barnes & Thornburg

(57) ABSTRACT

The invention relates to tubular knitwear items provided with suitable openings or holes (H) automatically obtained for shoulder straps (SS, SD), neck portions (GC), belts, strings, stripes, knots (K), loops and the like, i.e. for various applications and purposes, such as anatomic support, and for aesthetic and functional connections and weavings also with other manufactured items. The invention coordinates the suitable needle (A) selection according to the jacquard design and to the work cycle of the knitting machine and enable, for definite fabric areas and needles (A), the temporary stop of the knitting process and the subsequent stitch discharge, followed by the production of new fabric stitches, also with needle discard and floating yarns (FF) so as to obtain transparent effects and the production of fringes.

24 Claims, 4 Drawing Sheets

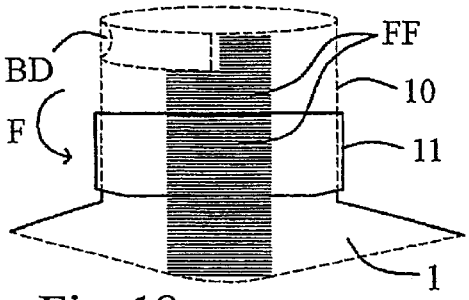
Fig. 18
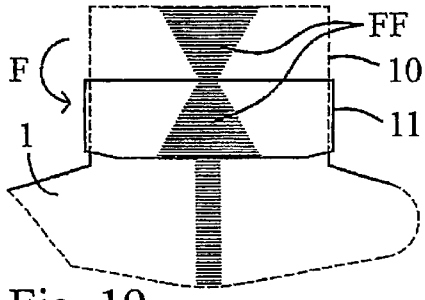
Fig. 19
Fig. 20
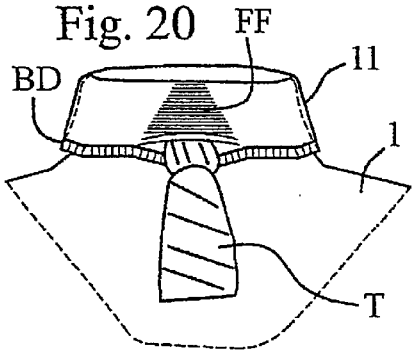
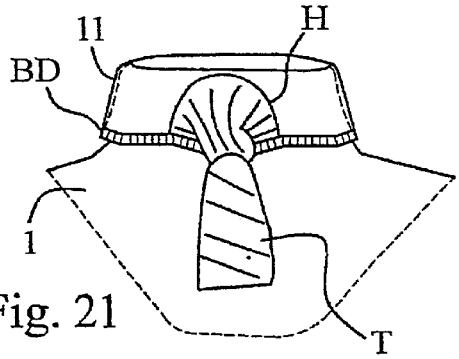
Fig. 21
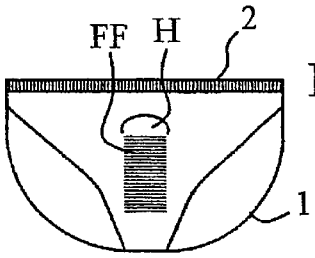
Fig. 22
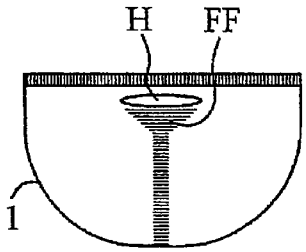
Fig. 23
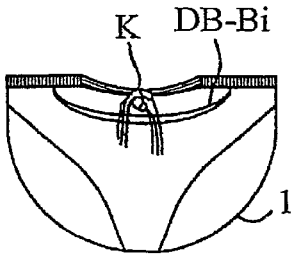
Fig. 22B
Fig. 22A
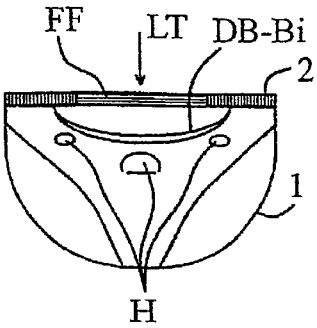
Fig. 23A
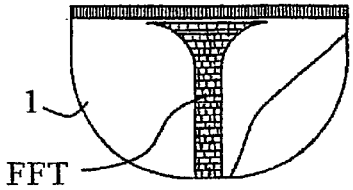

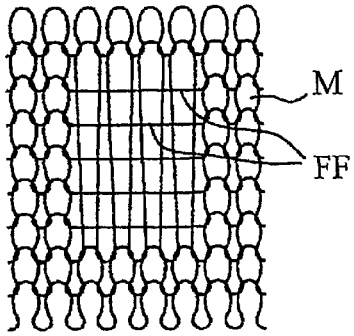
Fig. 24
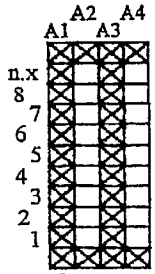
Fig. 25
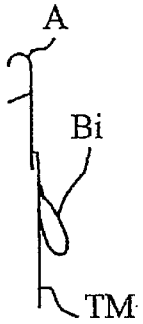
Fig. 26A
Fig. 26
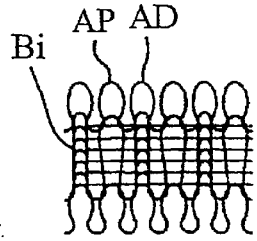
Fig. 24A
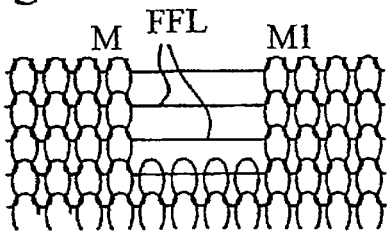
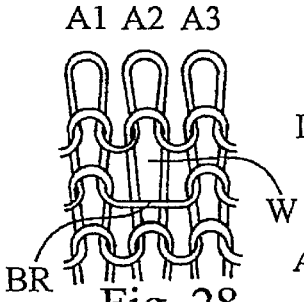
Fig. 28
Fig. 27
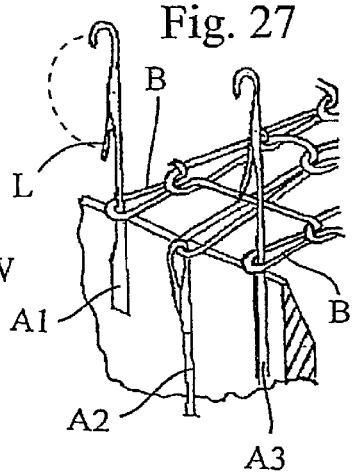
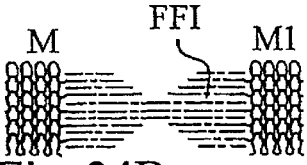
Fig. 24B
Fig. 29
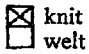
Fig. 30
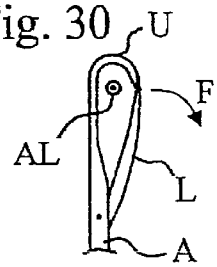
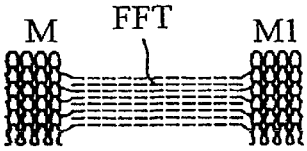
Fig. 24C
Fig. 31
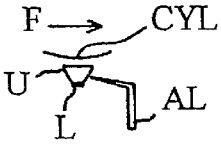
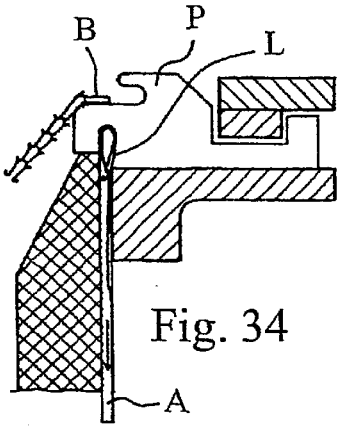
Fig. 34
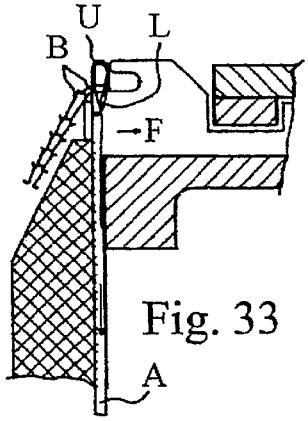
Fig. 33
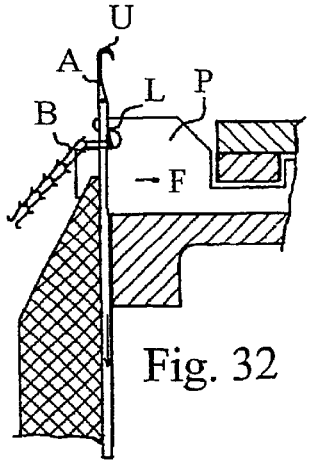
Fig. 32

METHOD FOR PRODUCING TUBULAR KNITWEAR ITEMS AND PRODUCTS OBTAINED THEREBY

TECHNICAL FIELD

The introduction of "full electronic" circular knitting machines with differentiated diameters has attracted the knitting industry's interest since their versatility allows to produce a wide range of tubular items, such as for instance bras, brassieres, pants, dresses, trousers, "fuseaux" (tight trousers), skirts, teddies, swimsuits, technical items and more. But due to some inherent technical and textile limitations, such as for instance the lack of shoulder straps, belts, loops, strings, ribbons and various openings, most of the aforementioned knitwear items systematically require laborious and expensive additional finishing operations such as cutting and sewing, with the subsequent fabric scraps which affect production costs extensively and permanently. As is generally known, Italian patent no. 1288310 provides for various embodiments concerning the production of shoulder straps, loops or braces, or various openings for legs and arms; these solutions, however, show technical difficulties and additional costs due to the complex mechanisms involving fabric pick-up and transport from one side of the needle cylinder to the other side.

AIMS OF THE PRESENT INVENTION

The present invention aims at reducing to a significant extent or at wholly eliminating the aforesaid technical and productive limitations, so as to automatically obtain semi-finished or finished tubular knitwear items, preferably provided with shoulder straps, loops, fabric stripes, buttonholes and various openings, also with floating yarns, with original productive, technical, aesthetic and commercial purposes. All this stated, a main aim of the present invention consists in providing a method and apparatus for producing tubular items, also shaped or fitted, provided with one or more holes or openings, also quite wide, said items being automatically produced by the suitable selection and presence of the elements directly or indirectly involved in the knitting process, such as for instance jacks, needles, under-needles and fabric sinkers. An additional aim consists in providing a method and apparatus for producing said tubular items provided with at least a fabric half-ring, preferably introduced into one or more holes of said item or used for the aesthetic or functional connection or weaving with a separate item. Another aim consists in providing a method and apparatus for producing items provided with one or more loops or fabric stripes, which are connected to the knitted tube only on their ends, also with their floating yarns only, being automatically produced by the suitable presence or absence of needles. A further aim consists in providing said tubular items with one or more zones without fabric, said zone being automatically produced by the suitable selection of the elements directly or indirectly involved in the knitting process, and being covered with floating yarns. An additional aim consists in producing said tubular items provided with one or more openings or holes characterized by a plurality of floating yarns. Further aims will be evident from the description, examples and accompanying drawings, per se or in combination, beyond the final claims.

DISCLOSURE OF THE INVENTION

The above mentioned aims are substantially achieved by a method for producing tubular knitwear items by discharging and taking up single stitches following a given pattern, also with needle discard and floating yarns, and products obtained thereby, according to the appended claims. The characteristics of the invention and the advantages resulting therefrom will be more evident from the following description of embodiments provided by way of example, which can be advantageously applied to the majority of knitting machines.

BRIEF DESCRIPTION OF THE DRAWINGS

The description will be made with reference to the accompanying drawings in which:

FIGS. 18 and 19 show two different embodiments of collars strongly characterized by floating yarns;

FIG. 20 shows the collar of FIG. 19 with a tie introduced therein;

FIG. 21 shows a collar provided with a hole H in which a tie has been introduced;

FIGS. 22, 22A and 22B show the front portions of different embodiments of pants provided with holes and floating yarns, also cut and knotted;

FIGS. 23 and 23A show the rear portion of two pants 1 with floating yarns FF which are also variously woven;

FIG. 24 shows a fabric with a central zone having floating yarns FF;

FIG. 24A graphically shows a jersey fabric interrupted between M and M1 by floating yarns FFL alternated to the fabric;

FIGS. 24B and 24C graphically show jersey fabrics interrupted by different applications of intermeshed floating yarns FFI and FFT, variously manipulated and knitted for the different embodiments of the invention;

FIG. 25 technically show the mechanical-textile diagrams, i.e. the sequences to be followed in the production of the three-dimensional knit frills Bi;

FIG. 26 is a front view of a fabric having frills Bi made only with odd needles AD, with even needles AP not operating;

FIG. 26A shows a needle A, usually housed within a bed or cylinder, on whose stem the underlying fabric and the inner frill Bi are still engaged;

FIG. 27 is a perspective view of needles starting the sequences for the production of knit frills Bi, by weaving a single "bridle";

FIG. 28 shows a missing stitch W and a single "bridle" BR of the needle 2 within a knitted structure;

FIG. 29 is a technical key for the pattern of FIG. 11;

FIG. 30 is a side view of a needle A and a latch-opening device AL;

FIG. 31 is a plan view of a portion of cylinder CYL with the hook U of a needle and an adjacent latch-opening device AL;

FIGS. 32, 33 and 34 are a sequence of lateral views of needles A and sinkers PM during the discharge of the last fabric stitches B.

DESCRIPTION OF THE ILLUSTRATIVE EMBODIMENTS

Figure 1:
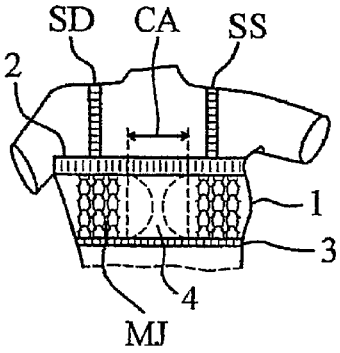
FIG. 1 shows a brassiere produced according to the prior art.
Figure 2:
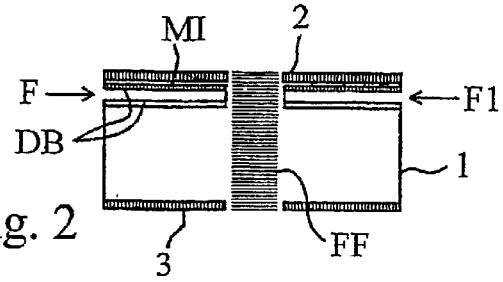
FIG. 2 shows a brassiere provided with neck portion and floating yarns, produced according to the present invention.
Figure 3:
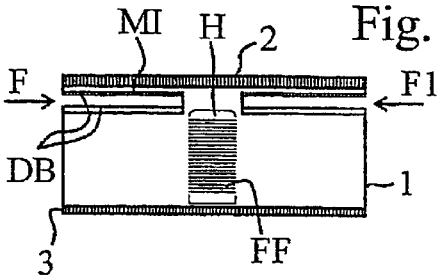
FIGS. 3 and 4 show different embodiments of brassieres provided with neck portion, holes and floating yarns, produced according to the present invention.
Figure 4:
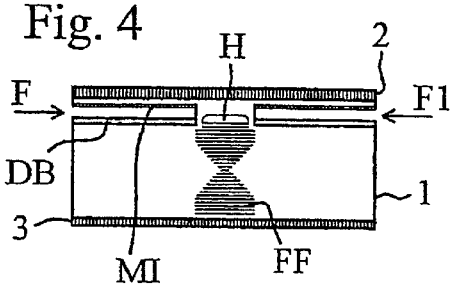

The following description will be carried out, with descriptive and non-limiting purposes only, with reference to a circular knitting machine for producing tubular knitted items in general comprising at least: a needle bed or rotary cylinder versus fixed cams or vice versa; a complete working feed, provided with one or more yarn feeders, also moving feeders; preferably electronic needle selection for controlling the elements involved in the knitting process according to a work cycle and/or a jacquard design; cams for knitting which can also be individually adjusted by means of a computer; a device for opening needle latches upon actuation; a fabric suction or pulling system; said machine being also equipped with a dial with selectable needles or jacks, beyond the usual yarn suction and cutting device. In particular most of the description relates to a "full electronic" single-cylinder circular machine such as for instance Santoni SM8. In the example taken from the prior art shown in FIG. 1, the traditional breast band or brassiere 1 consists of the jersey fabric MJ delimited by the usual upper two-layer elastic band 2 and lower two-layer elastic band 3. The shoulder straps SS and SD are first produced and then undergo a cutting-sewing operation, whereas the aesthetic and functional problem on the central part CA, i.e. the elimination of excess fabric beyond hatched lines 4, so as to obtain the classic breast shape. In a first preferred embodiment the invention is firstly carried out by preparing a work cycle or jacquard design, i.e. direct inputs to needles or jacks or other elements directly or indirectly involved in the knitting process, by means of a graphics workstation or other control and memory devices, i.e. by means of electromechanical, magnetic and optical apparatus, or other means suitable to said purpose. During its production, which can indifferently start from the aforesaid band 2 or 3, the manufactured item 1 of FIGS. 2–3–4 is generally modified according to the present invention both by producing floating yarns FF and individual holes H, variously placed, and by detaching a suitable number of successive stitches or loops in the direction of the courses, usually less than 360° of the needle cylinder. In the specific case the detachment of the above-mentioned stitches takes places on the arrows F and F1 around the needle cylinder, but for the front portion usually corresponding to said floating yarns FF or holes H. In practice the almost complete detachment of the upper band 2, which has just been manufactured, can take place in at least two ways: by means of a special thermo-soluble yarn used locally in specific areas, which totally or partially melts during the hot fixing stage; or preferably by temporarily canceling all feeds, by excluding the yarn feeders and by subsequently temporarily stopping the production cycle. Now, according to the jacquard design and to the work cycle, only programmed needles, which are grouped and placed adjacently in the specific case, are selected again and sent to at least a yarn-free ascending cam (not shown) so that they can be completely raised. The maximum raising of these needles results in two important situations: all their latches L automatically open and place themselves over the last stitches B, which are still laid in the needles, such as 1–3 in FIG. 27. The following descent stage of said needles is shown in FIGS. 32–33–34. The needle A of FIG. 32 begins its descent and the last stitch B, placed close against the stem of said needle, gets under the latch L and starts to close the latter automatically and progressively. If the needle descent goes on, said latches will be completely closed, FIG. 33, and will work as "bridges" for said stitches B, which are then definitely detached, as in FIG. 34. Simultaneously, also the fabric sinkers PM get back progressively and radially following arrow F, synchronously with the descent movement of the needles A. According to the invention the progressive discharge of said stitches B from the concerned needles preferably takes place after the production of one or more previous courses made of non-run fabric MI, FIG. 2, i.e. known textile structures characterized by the simultaneous presence of normal stitches, laid-in stitches and welts, said terms being known to people skilled in the art. As a matter of fact, in order to avoid unwanted runs, it is provided for a textile preparation stage according to which the last knitted courses produced before the last knitted course or waste W, FIG. 6, are characterized by knitted structures of net or non-run fabric, with variable thicknesses which are electronically controlled via a computer by the corresponding motorized knitting cams (not shown), together with the optional use of suitable yarns, for instance thermo-adhesive yarns, or anyhow melting gradually interlacing with the adjacent stitches. In this operating stage the total discharge of the stitches from the programmed needles causes within the knitted tube a horizontal continuous opening in the direction of the courses, which then forms a fabric half-ring (2 and GC, in FIGS. 2 to 8) only partially connected with the manufactured item. According to the invention, since the manufacturing process should necessarily be re-started, the needles which are now disengaged and temporarily fabric-free are selected and progressively directed onto at least an ascending cam following pre-defined selection sequences such as for instance 1:6 (or 1:3, an operating needles and three excluded needles) and 1:1. On the basis of technical-textile contingent features first all needles and/or only half of the disengaged needles, the odd ones afterwards for instance, take up the ready yarn again to re-start knitting in at least a feed, for the production of a hem or double welt DB, or two-layer welt, such as Bi (inner frill) in FIG. 26. At the beginning of their ascent the needles which are still disengaged and with still closed latches L find on their obligatory path a latch-opening device AL which forcedly opens said latches.

The described procedure is schematically shown in FIG. 30: the latch L is still against the jack of the needle U into which a latch-opening metal tip AL is automatically placed, operating until the latch L is opened and overturned in the direction of arrow F. FIG. 31 is a plan view of a portion of the cylinder CYL rotating in the direction of the arrow F, with the jack or hook U of the needle against which the latch L and the adjacent latch-opening device AL are placed. The jack or hook U of the needle, adhering to the latch L, finds on its obligatory ascending path the latch-opening device AL, which has been introduced to this specific purpose. Once the needle latches have been opened as previously described (in other embodiments the latch is opened by means of a suitable intake of compressed air coming from above, or by means of a thin plate inserted between the hook and the latch), the knitting process starts again.

According to the present invention the second knitting cycle re-starts both with a single or with a double welt such as DB in FIGS. 2–3–4 by the fixed selection of alternated needles such as Bi in FIG. 26. In order to obtain different aesthetic and commercial results, the knitting process can also be re-started in a different way, i.e. with a number of needles which has been greatly reduced with respect to normal conditions, the so-called needle discard, so as to produce one or more zones in which fabric is replaced by floating yarns which are generally indicated with FF in the various figures. The best results can usually be obtained by excluding for a relatively long period a suitable number of needles since the beginning of the knitting process, though by taking suitable precautions satisfying results can also be obtained in other positions of the manufactured item, provided that the stitches are suitably discharged by the needles which have to be disengaged from the knitting process. The above-described technique therefore allows to produce almost in every part of the manufactured item the holes generally indicated with H, having different purposes. In FIG. 6, the fabric ring 2 or neck portion GC, only partially connected with the underlying knitted tube 1, is preferably and successively introduced into the central hole H following arrows F, or otherwise, until it takes on the shape and functions of the neck portion GC in FIG. 8. By suitably coordinating the width of the aforesaid hole H with suitable structure of open-work fabric JO in the central zone CA and around the breast, which is produced with expressly larger fabric MA, said neck portion GC in FIG. 8 also has functions of anatomic support of the breast zone.

Figure 5:
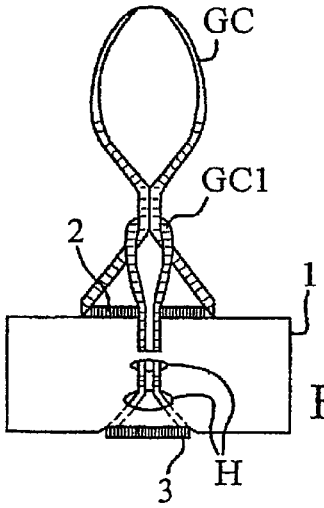
FIG. 5 shows a knitted item with a first band introduced into a hole and into a second band.
Figure 6:
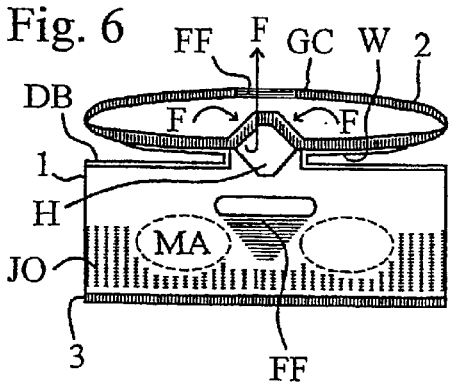
FIG. 6 shows another embodiment of a brassiere.
Figure 8:
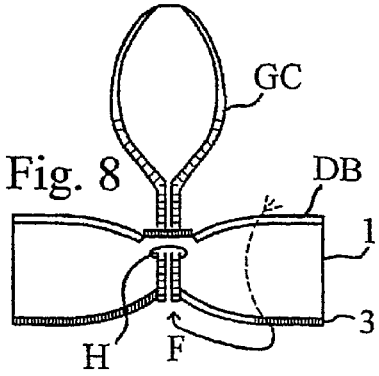
FIGS. 7 and 8 show the steps for introducing a neck portion of a brassiere into a hole of the brassiere.
Figure 7:
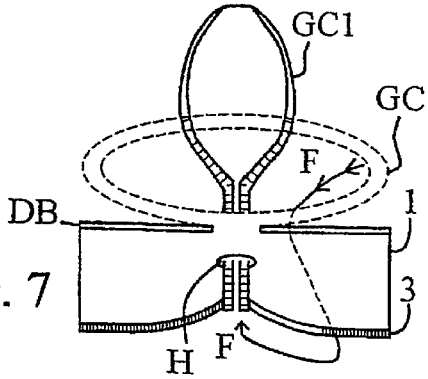
Figure 9:
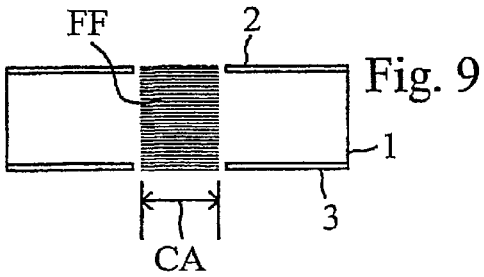
FIGS. 9 and 10 show two embodiments of a brassiere provided with floating yarns FF.
Figure 10:
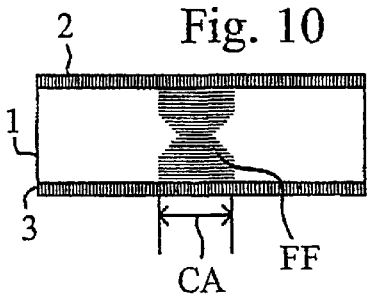
Figure 11:
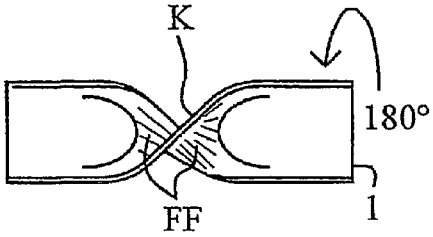
FIG. 11 shows one of the brassieres of FIG. 9 or 10 which undergoes a torsion in the zone K between the breasts with an anatomically interesting shaping.
Figure 12:
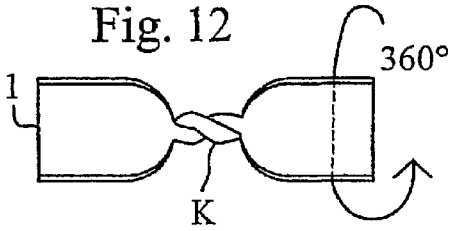
FIG. 12 shows one of the brassieres of FIG. 9 or 10 which is completely knotted in the zone K between the breasts with another shaping.
Figure 13:
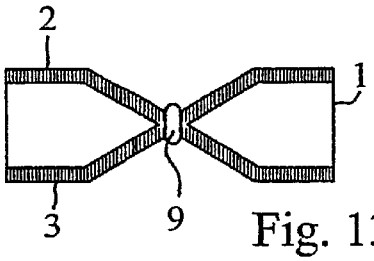
FIGS. 13, 14 and 15 are different embodiments of knitted items with welts 2 and 3 close one to the other or overlap by means of additional external elements 9 or K.
Figure 14:
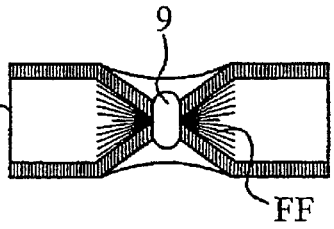
Figure 15:
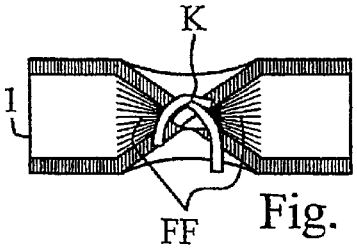
Figure 16:
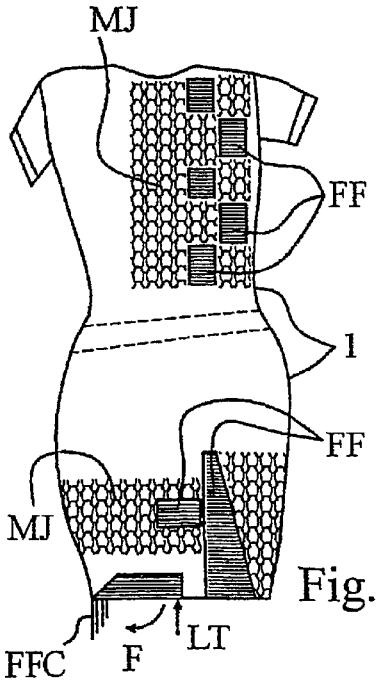
FIGS. 16 and 17 show two dresses with different arrangements of floating yarns FF, which can also be cut such as FFC.
Figure 17:
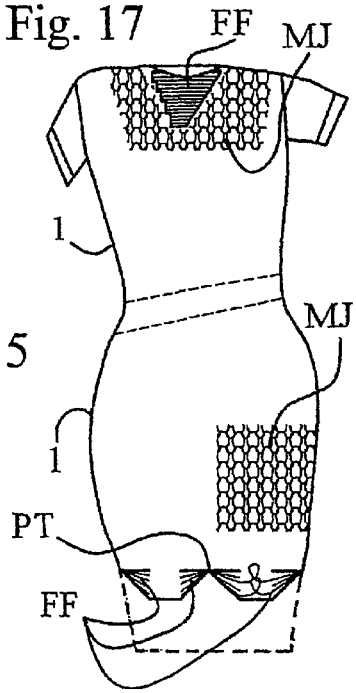

A variation of the described technique is shown in FIG. 5: in the specific case the double-welt bands, referred to in FIG. 2 with numerals 2 and 3, which were first clearly separated from the knitted tube 1, are then introduced one into the other to obtain original combinations and aesthetic and functional connections which can also apply to other cases beyond the example shown. As far as FIGS. 3–4–6 are concerned, the zone between the breasts is widely characterized by a plurality of floating yarns FF, placed directly under the opening H; to various aesthetic and functional purposes said floating yarns can also be differently knitted, as indicated in FIGS. 24B and 24C. In the case of FIG. 6, the width of said floating yarns FF gradually decreases because of the progressive programmed introduction of the disengaged needles into the knitting cycle. On the contrary, if the width of the manufactured floating yarns has to be gradually increased, the needles placed at the ends are gradually excluded from the knitting process after discharging the last stitches. FIGS. 9 and 10 show a pectoral band or brassieres 1, characterized by a vertical area CA covered with floating yarns FF, which can be placed on the opposite side of the knitted tube or in different places in other embodiments. Said brassiere, which is partially folded inwards for a half turn of 180°, FIG. 11, takes on an interesting anatomic shape especially on the central portion K, which can be better seen in the embodiment of FIG. 12, because of the complete turn corresponding to 360°. The aforesaid pectoral band or brassiere 1 of FIGS. 9 and 10 can be anatomically shaped on the breast as shown in FIGS. 13 and 14, i.e. by forcedly approaching welts 2 and 3 (which can also overlap, FIG. 13) and by pressing them with a suitable additional element 9, which can indifferently be a snap-hook, a buckle, a ring consisting of two half-rings fitting one into the other, or simply the knot K of FIG. 15. FIGS. 9 and 10 can also represent different knitted items produced in the same way, for example a scarf. FIGS. 16 and 17 relate to other knitwear items 1 falling within the framework of the invention, characterized among other things by various combinations of floating yarns FF alternated to jersey fabric MJ. In particular, the lower hem of the manufactured item 1 in FIG. 16 is further characterized in that the original floating yarns, which are then cut along line LT, descend following arrow F and take on the final position FFC which makes them similar to a fringed hem. On its side the lower hem of the manufactured item 1 in FIG. 17 is characterized by the presence of floating yarns FF alternated to fabric, which are centrally gathered together by at least a tuck stitch PT, a term known to people skilled in the art. Table 3 shows details of other embodiments falling within the framework of the present invention. FIG. 18 shows the initial portion of a knitted tube 10 provided with a double welt BD with the front central portion characterized by floating yarns FF. The knitted portion 10 is folded on itself and acts as a collar. In FIG. 19 the different presence of floating yarns FF produces a final result which is closer to the anatomic shape of traditional collars 11. FIG. 20 shows a different embodiment completed by the tie T inserted between the double welt BD and the floating yarns FF of the collar 11. In FIG. 21 the tie T is inserted into the only hole H made according to the invention. Therefore the collar 11 of FIGS. 20 and 21 takes on in a more evident way the shapes and functions of the traditional shirt collar, completed by the tie T. FIGS. 22 to 23A show the pants 1 characterized by the presence of floating yarns FF preferably placed in central position. In FIG. 22 the plurality of floating yarns FF is on the front portion of the pants 1 and their beginning takes place after the stitch discharge causing hole H. FIG. 22A shows the floating yarns FF which have to be cut along LT for the final knot F of FIG. 22B. DB-Bi indicates the double welts produced according to the invention at the beginning of the new work cycle. The rear portion of the pants 1 is shown in FIG. 23; the different lies in that the extension of floating yarns is gradually reduced according to the technique described above so as to anatomically shape the manufactured item for a better wearability and comfort. In FIG. 23A the rear portion of the pants 1 is further characterized by floating yarns interrupted by some operating needles which are diagonally spaced with a sequence varying from 1:3 to 3:1, i.e. an operating needle followed by three excluded needles, or vice versa, a sequence with diagonal rotation which is similar to hosiery known micromesh, preferably without any tuck stitches. More generally, wide and vertically repeated floating yarns can be further handled and gathered together in the central portion in a butterfly shape by means of suitably placed isolated needles operating in laid-in position, a term known to people skilled in the art. The details of execution of the present invention can equally vary as far as shape, dimensions and/or arrangement are concerned, and also for the nature of the technical and/or textile materials used, though always falling within the framework of aims of the present patent.

What is claimed is:

1. Method for automatically producing three-dimensional tubular knitwear items, in circular knitting machines provided with at least a cylindrical needlebed (CYL), characterised in that it comprises the steps of:

inactivating and excluding automatically, for a predetermined time interval, at least a predetermined number of adjacent needles (A) of the needlebed (CYL), said excluded needles having corresponding stitches, said excluded needles discharging said corresponding stitches, said excluded needles being chosen from at least a defined knit area of the needlebed (CYL), and with a plurality of remaining working needles (A) of the needlebed (CYL) and with continuous motion of the needlebed (CYL), producing a first length of tubular knitted fabric (1) having an annular shape and having a plurality of floating yarns (FE) in a zone of the knitted item (1) corresponding to said defined area of the needlebed (CYL).

2. The method according to claim 1 characterised in that at least a part of said predetermined number of needles (A) discharges the corresponding stitches only progressively.

3. The method according to claim 1 characterised in that it further comprises, before said step of inactivating and excluding at least a predetermined number of adjacent needles (A), the step of producing a second length of tubular knitted fabric (1), said predetermined number of needles (A) completely releasing and discharging the corresponding stitches (1) during said step of inactivating and excluding from the knitting process said predetermined number of adjacent needles (A), whereby at least an opening (H) is produced between said second length and said first length of the knitted item (1), in a zone corresponding to said defined knit area.

4. The method according to claim 1 characterised in that it further comprises the steps of reintroducing said predetermined number of needles (A) in the knitting process after said predetermined time interval, by an automatic and programmed resumption of knitting with said predetermined number of needles (A), and producing, after said first length of knitted fabric (1), a third length of tubular knitted fabric (1).

5. The method according to claim 1 characterised in that it further comprises the step of cutting said floating yarns (FF), in a phase subsequent to the knitting process of the knitted item (1), to obtain in said zone of the knitted item an opening (H) with fabric edges provided with fringes (FFC).

6. The method according to claim 3 characterised in that it further comprises the steps of:

reintroducing said predetermined number of needles (A) in the knitting process immediately after said step of inactivating and excluding from the knitting process at least a predetermined number of adjacent needles (A) of the needlebed (CYL), by an automatic and programmed resumption of knitting with said predetermined number of needles (A), and resuming the knitting process with both the excluded needles (A) and the remaining needles (A) and producing a third length of tubular knitted fabric (1), thus providing at least an opening (H) in the knitted item (1) between said second and said third length of knitted fabric (1), in said defined area of the needlebed (CYL) corresponding to the excluded needles (A), with a controlled partial separation of two theoretically consecutive stitch courses.

7. The M method according to claim 6 characterised in that the dimension of said defined knit area is less that 360° and determined in order to obtain an opening (H) defining in said item at least a fabric stripe, neck portion (GC), half-ring, loop, shoulder strap (SD,SS) or brace, which is at least partially connected to the knitted item (1).

8. The method according to claim 7 further comprising the step of providing said shoulder straps (SD,SS), braces and/or openings (H) with hemmed fabric and with at least a single or double layer welt (BD), said welt being produced with the needles (A) of the cylindrical needlebed (CYL) and by means of a second needlebed or dial.

9. The method according to claim 7, further comprising the step of providing said shoulder straps(SD,SS), braces and/or openings (H) with hemmed fabric and with at least a single or double layer welt (BD), said welt being produced with the needles (A) of the cylindrical needlebed (CYL) by producing two layer inner frills (Bi) with a fixed selection of alternated needles (A).

10. The method according to claim 4 characterised in that at least a part of said predetermined number of needles (A) is reintroduced in the knitting process progressively.

11. The method according to claim 1 in which said step of inactivating and excluding from the knitting process at least a predetermined number of adjacent needles (A) of the needlebed (CYL) comprises the step of interrupting the knitting process with all the needles (A) of the needlebed (CYL) in non-working position and all the yarn-feeders excluded and releasing the loops of the knitted fabric (1) engaged to said predetermined number of excluded needles (A), while the remaining needles (A) of the needlebed (CYL) retain their loops of knitted fabric (1).

12. The method according to claim 1, comprising providing automatically said items with one or more one or more shoulder straps (SD,SS), neck portions (GC), half-rings, openings and/or floating yarns (FF), operating with the continuous motion of the needle cylinder and by the temporary and gradual interruption of the knitting process for a group of adjacent needles (A) discharging corresponding stitches, in definite fabric areas, less than 360°, followed by the automatic and gradual re-start of the knitting process, with the same needles (A) or in the same definite fabric areas, after the intervention of mechanical or pneumatic elements working as latch-opening devices (AL), for the controlled separation of two knitted courses which are theoretically consecutive and also partially overlapping; said courses being characterised in that one of them represents the last course of knitted fabric (1) produced before said interruption and the other one the first course produced after said interruption, thus obtaining finished and semi-finished tubular knitted items without cutting and sewing operations.

13. The method according to claim 7 characterised in that it comprises the steps of folding and introducing or connecting at least partially said fabric stripe, neck portion (GC), half-ring, loop, shoulder strap (SD,SS) or brace in at least a hole or other opening (H) of the manufactured item (1).

14. The method according to claim 7 characterised in that it comprises the steps of folding and introducing or connecting at least partially said fabric stripe, neck portion (GC), half-ring, loop, shoulder strap (SD,SS) or brace in at least a hole or other opening (H) of another knitted article, textile manufactured item or accessory.

15. The method according to claim 7 characterised in that at least a portion of said neck portion (GC), half-ring or other fabric stripe is produced with a plurality of floating yarns (FF) instead of the fabric (1).

16. The method according to claim 1 characterised in that the knitting process of the excluded needles (A) is preceded by the intervention of latch-opening devices (AL) and starts again only progressively with selected needles (A) always following an alternated order, in at least a feed provided with yarn.

17. The method according to claim 1 characterised in that the discharge of the stitches from part of the needles (A) is carried out after the production of, one or more knitted courses.

18. The method according to claim 1 characterised in that the discharge of the stitches from part of the needles (A) takes place by totally lowering said needles (A) without new yarn under a pulling-down plane of the sinkers (PM), synchronously with a radial removal of the latter.

19. The method according to claim 1 characterized in that it further comprises the step of turning inwards or folding on itself, for at least 180°, at least a part of the manufactured item (1).

20. The method according to claim 1 comprising the step of introducing a portion of the knitted item (1) into a connection element (9, K), to join up two opposite welts (2,3) of the knitted item (1).

21. The method according to claim 3 characterized in that at least a part of the holes and openings (H) are fabric-free and are covered with alternating floating yarns (FF) produced according to a design pattern or work cycle of the textile machine.

22. The method according to claim 1 characterized in that it further comprises the step of gathering together said floating yarns (FF) by means of tuck stitches.

23. The method according to claim 1 for producing a shirt having a collar (10,11) comprising the step of providing said collar (10,11) with an opening (H) or a plurality of floating yarns (FF) adapted to allow the introduction of a tie (T) in said hole (H) or between said floating yarns (FF).

24. Knitted item as obtainable by a process according to claim 1 characterized by at least a first initial double welt (DB), also elastic, followed by at least an opening (H) or neck portion (GC), followed by a suitable number of knitted courses and with the presence of floating yarns (FF) instead of the fabric (1) according to a design pattern or discharge of needles (A) or needle groups, and ending with a final double welt (DB), also elastic.

* * * * *